US011951535B1

(12) United States Patent
Feng et al.

(10) Patent No.: US 11,951,535 B1
(45) Date of Patent: Apr. 9, 2024

(54) CASTING FURNACE FEATURING SUBMERGED, MECHANICAL CONTROL OF LIQUID LEVEL

(71) Applicant: ZHEJIANG HAILIANG CO., LTD., Zhejiang (CN)

(72) Inventors: Huanfeng Feng, Shaoxing (CN); Gangfeng Sun, Shaoxing (CN); Weimin Ma, Shaoxing (CN); Xuelong Zhao, Shaoxing (CN)

(73) Assignee: ZHEJIANG HAILIANG CO., LTD., Shaoxing (CN)

( * ) Notice: Subject to any disclaimer, the term of this patent is extended or adjusted under 35 U.S.C. 154(b) by 0 days.

(21) Appl. No.: 18/239,234

(22) Filed: Aug. 29, 2023

(30) Foreign Application Priority Data

Dec. 23, 2022 (CN) ..... 202211667588.7
Dec. 23, 2022 (CN) ..... 202211669176.7

(51) Int. Cl.
*B22D 11/18* (2006.01)
*B22D 11/055* (2006.01)

(52) U.S. Cl.
CPC ..... *B22D 11/181* (2013.01); *B22D 11/055* (2013.01)

(58) Field of Classification Search
CPC ..... B22D 11/181; B22D 11/055
See application file for complete search history.

(56) References Cited

U.S. PATENT DOCUMENTS

2021/0379652 A1 12/2021 Gerner et al.

FOREIGN PATENT DOCUMENTS

| | | | |
|---|---|---|---|
| CN | 101157121 A | * | 4/2008 |
| CN | 111854431 A | | 10/2020 |
| CN | 112658236 A | | 4/2021 |
| CN | 214768847 U | | 11/2021 |
| CN | 217474826 U | | 9/2022 |
| CN | 116021006 A | | 4/2023 |
| CN | 116037910 A | | 5/2023 |

(Continued)

OTHER PUBLICATIONS

English machine translation of CN-101157121-A (Year: 2008).*

(Continued)

*Primary Examiner* — Kevin P Kerns
*Assistant Examiner* — Steven S Ha
(74) *Attorney, Agent, or Firm* — Oliff PLC

(57) ABSTRACT

Disclosed is a casting furnace featuring submerged, mechanical control of liquid level, which relates to continuous casting and solves the problem of low billet productivity. The casting furnace featuring submerged, mechanical control of liquid level includes a melting furnace, a holding furnace, and a crystallizer, the crystallizer including a chamber for accommodating metal liquid, the holding furnace communicating with the melting furnace and the chamber, respectively, a traction head being provided on the crystallizer, the chamber maintaining communication with the holding furnace, the holding furnace including a liftable immersion device, the immersion device being submerged in the metal liquid to elevate liquid level height in the chamber; the crystallizer having a liquid level detecting device, lift height of the immersion device being adjusted based on a detection signal of the liquid level detecting device such that the liquid level in the chamber is maintained at a preset height.

13 Claims, 8 Drawing Sheets

(56) References Cited

FOREIGN PATENT DOCUMENTS

| | | | | |
|---|---|---|---|---|
| CN | 219169605 | U | | 6/2023 |
| CN | 219274461 | U | | 6/2023 |
| JP | 63119965 | A | * | 5/1988 |
| JP | 2008-279501 | A | | 11/2008 |

OTHER PUBLICATIONS

English machine translation of JP-63119965-A (Year: 1988).*
Nov. 24, 2023 International Search Report issued in International Application No. PCT/CN2023/113533.
Nov. 24, 2023 Written Opinion issued in International Application No. PCT/CN2023/113533.

* cited by examiner

CASTING FURNACE FEATURING SUBMERGED, MECHANICAL CONTROL OF LIQUID LEVEL

FIELD

The subject matter described herein relates to continuous casting, and more particularly relates to a casting furnace featuring submerged, mechanical control of liquid level.

BACKGROUND

Presently, the Chinese Patent Application No. CN112743057A has disclosed a red copper billet horizontal continuous casting furnace installation used in a foundry, where a red copper billet is drawn by a traction device to a set length and then automatically cut off by a sawing machine; the cut red copper billets are conveyed and discharged via a fast billet conveying mechanism and a discharging roller way, thereby eliminating a need of lifting the billets by an overhead crane and then cutting. In the red copper billet horizontal casting furnace installation, the bottom of the holding furnace communicates with the bottom of the crystallizer which is arranged in horizontal parallel to the holding furnace, such that the liquid levels in the holding furnace and the crystallizer are maintained in flush; a traction head for drawing copper billets is disposed on the crystallizer. When the copper liquid level in the crystallizer drops near the traction head, the copper billet cannot be drawn into a standard shape; in this case, it is needed to replenish copper liquid into the holding furnace to elevate the liquid level in the crystallizer. However, at this point, much copper liquid remains in the holding furnace and cannot be utilized; in addition, frequent replenishment of the copper liquid dampens productivity. Moreover, the above-identified patent exhibits an intermittent pattern in transferring the copper liquid from the melting furnace into the holding furnace, while the casting in the holding furnace is non-intermittent; a consequence is that the copper liquid inside the holding furnace has a relatively large fluctuation, directly affecting quality stability of billet production.

SUMMARY

Embodiments of the disclosure provide a casting furnace featuring submerged, mechanical control of liquid level, which overcomes the above and other problems of prior art such as low billet production efficiency and highly instable billet quality.

The disclosure adopts a technical solution below:

A casting furnace featuring submerged, mechanical control of liquid level, comprises a melting furnace, a holding furnace, and a crystallizer, the crystallizer comprising a chamber for accommodating metal liquid, the holding furnace communicating with the melting furnace and the chamber, respectively, a traction head being provided on the crystallizer, the chamber maintaining communication with the holding furnace, wherein the holding furnace comprises a liftable immersion device, the immersion device being submerged in the metal liquid to elevate liquid level height in the chamber; and the crystallizer has a liquid level detecting device, a lift height of the immersion device being adjusted based on a detection signal of the liquid level detecting device such that the liquid level in the chamber is maintained at a preset height.

Based on the technical solution above, the immersion device comprises an immersion body and a lift rod connected to the immersion body, and a drive configured to drive the lift rod to perform an up-and-down movement relative to the holding furnace is provided on the holding furnace.

Based on the technical solution above, the immersion body is hollow inside.

Based on the technical solution above, the crystallizer further comprises a furnace body and a cooling jacket disposed on the furnace body, the chamber being defined by the furnace body, the traction head drawing the metal liquid from the cooling jacket such that the metal liquid is cooled into a metal billet in the cooling jacket.

Based on the technical solution above, a lower end of the holding furnace is in communication with a lower end of the crystallizer, and a bottom wall of the holding furnace is lower than a bottom wall of the chamber.

Based on the technical solution above, the bottom wall of the holding furnace is gradually elevated towards the direction of the crystallizer, the bottom wall of the chamber is gradually lowered towards the direction of the holding furnace, the holding furnace and the crystallizer communicate via a fluid channel, and an end of the fluid channel connected to the holding furnace is gradually elevated towards another end of the fluid channel connected to the crystallizer.

Based on the technical solution above, an upper end of the holding furnace is provided with a metal liquid inlet communicating with the melting furnace, a bottom wall of the melting furnace has a metal liquid outlet communicating with the metal liquid inlet, and the bottom wall of the melting furnace at a side of the metal liquid outlet is recessed downward to form an impurity deposition sector.

Based on the technical solution above, a first baffle plate is provided at a side of the holding furnace proximal to the metal liquid inlet, a gap for the metal liquid to flow is formed between the first baffle plate and the bottom wall of the holding furnace, and an end of a bottom portion of the holding furnace distal from the gap communicates with the chamber.

Based on the technical solution above, a second baffle plate is provided at a side of the melting furnace distal from the metal liquid outlet, a raw material inlet is enclosed between the second baffle plate and an end portion of the melting furnace, and the impurity deposition sector is located outside a projection range of the raw material inlet in a vertical direction.

Based on the technical solution above, the casting furnace featuring submerged, mechanical control of liquid level further comprises a double-acting switch valve, the double-acting switch valve comprising a mounting bracket and two mutually backup sealing assemblies disposed on the mounting bracket, each sealing assembly comprising a carbon rod and a carbon rod moving assembly, the carbon rod moving assembly being configured to translate, and elevate or lower the carbon rod so as to block or open the metal liquid outlet via the carbon rod.

Based on the technical solution above, a third baffle plate is provided at the bottom wall of the holding furnace proximal to the crystallizer, one side of the third baffle plate facing the crystallizer is a flow guide surface skewing towards the crystallizer from top to.

Based on the technical solution above, the third baffle plate is disposed lower than a cast center of the traction head, a plurality of through-holes spaced along a height direction being provided on the third baffle plate.

Based on the technical solution above, a plurality of immersion devices are provided, the plurality of immersion devices sequentially descending into the metal liquid during continuous casting.

Based on the technical solution above, the liquid level detecting device comprises a float ball, a floating rod connected to the float ball, and a sensor configured to detect displacement of the floating rod to determine a liquid level height, a positioning mechanism being provided on the crystallizer, the positioning mechanism comprising at least two roller sets spaced along a vertical direction, each of the two roller sets comprising rollers pairwise disposed at two sides of the floating rod and rolling with floating of the floating rod.

A double-acting switch valve comprises: a mounting bracket and two mutually backup sealing assemblies disposed on the mounting bracket, each of the two sealing assemblies comprising a carbon rod and a carbon rod moving assembly, the carbon rod moving assembly being configured to translate, and elevate or lower the carbon rod so as to block or open a metal liquid channel between two metal liquid furnaces.

Based on the technical solution above, the carbon rod moving assembly comprises a lift mechanism having a carbon rod clamping device, and a translational mechanism for driving the lift mechanism to perform a translational movement; a metal liquid control position is provided on the mounting bracket; a sealing assembly resting at the metal liquid control position brings the carbon rod to move up or down via the lift mechanism to block or open the metal liquid channel between two metal liquid furnaces; the two sealing assemblies are symmetrically disposed; wherein when the carbon rod of one of the two sealing assemblies is worn down, the sealing assembly exits the metal liquid control position via cooperation between the lift mechanism and the translational mechanism, and another of the two sealing assemblies moves to the metal liquid control position via cooperation between the lift mechanism and the translational mechanism.

Based on the technical solution above, the two sealing assemblies are disposed at a same side of the mounting bracket, each of the two sealing assemblies further comprising a sliding plate and a slide rail, the sliding plate being slidingly mounted on the slide rail, the lift mechanism being disposed on the sliding plate, the translational mechanism being disposed on the mounting bracket and configured to drive the sliding plate to slide along the slide rail.

Based on the technical solution above, the double-acting switch valve further comprises a carbon rod automatic replacing mechanism, the carbon rod automatic replacing mechanism comprising a housing, a reservoir provided in the housing, and a discharge port disposed on the housing and communicating with the reservoir, the carbon rod being stored in the reservoir and operable to fall off via the discharge port so as to be clamped by the carbon rod clamping device.

Based on the technical solution above, the carbon rod clamping device refers to a hydraulically or pneumatically controlled clamping jaw, the clamping jaw releasing the carbon rod when exiting the metal liquid control position such that the carbon rod falls into the metal liquid furnace; the clamping jaw moves, via cooperation between the lift mechanism and the translational mechanism, to move below the discharge port to thereby clamp the carbon rod.

Based on the technical solution above, the carbon rod comprises a carbon rod body and a large-diameter segment at an upper end of the carbon rod body; the discharge port comprises a first discharge port and a second discharge port, a size of the first discharge port being smaller than a size of the large-diameter segment, a size of the second discharge port being greater than a size of the large-diameter segment; when the carbon rod falls off via the first discharge port, the large-diameter segment abuts against the housing around the first discharge port; a through groove mutually communicating with the first discharge port and the second discharge port is disposed therebetween; the carbon rod clamping device is operable to bring the clamped carbon rod to the second discharge port so as to be detached from the housing.

Based on the technical solution above, the carbon rod further comprises a small-diameter segment with a size greater than a size of the carbon rod body, the small-diameter segment being disposed below the large-diameter segment, a clamped segment for being clamped by the carbon rod clamping device being formed between the small-diameter segment and the large-diameter segment, the size of the small-diameter segment being smaller than the size of the first discharge port.

Based on the technical solution above, the mounting bracket comprises a fixed mounting bracket and a rotary mounting bracket rotatably mounted on the fixed mounting bracket, the two sealing assemblies being disposed at two sides of the rotary mounting bracket, respectively, the two sealing assemblies being symmetrical relative to a rotating axis center of the rotary mounting bracket, the housing being fixedly connected to the fixed mounting bracket, a drive motor configured to drive the rotary mounting bracket to rotate being provided at a bottom of the housing, the rotary mounting bracket bringing the sealing assembly to rotate such that the carbon rod moves from the first discharge port to the second discharge port.

Based on the technical solution above, a limit plate and a drive mechanism for driving the limit plate to slide are slidingly mounted below the first discharge port.

Based on the technical solution above, an elastic pressing plate configured to push the carbon rod to move towards a direction of the discharge port is provided in the reservoir, an end of the reservoir proximal to the discharge port is gradually shrunk towards the direction of the discharge port, a bottom wall of the end of the reservoir proximal to the discharge port is gradually inclined downwardly.

The disclosure offers benefits below:

The casting furnace disclosed herein comprises a melting furnace, a holding furnace, and a crystallizer, where the melting furnace is configured to melt raw materials into metal liquid and treat the metal liquid such that compositions thereof conform to billet manufacturing criteria, the holding furnace is configured to hold the treated metal liquid and supply the metal liquid to the chamber, and the traction head connected to the crystallizer is configured to draw the metal liquid from the crystallizer into a tubular blank or a billet stand. When the metal liquid level in the chamber drops below the center of the traction head, billet production is interrupted. The holding furnace is provided with a liftable immersion device; the immersion device can perform an up-and-down movement so as to be submerged into the metal liquid in the holding furnace, thereby elevating the metal liquid level in the holding furnace; since the holding furnace is in communication with the chamber, elevation of the metal liquid level in the holding furnace can also lead to elevation of the metal liquid level in the chamber; this may improve utilization of the metal liquid and reduce replenishing frequency of the metal liquid, thereby improving productivity. In addition, if the casting furnace becomes scrapped, the residual metal liquid in the furnace may also be reduced, thereby reducing economic loss.

By controlling the depth of the immersion device submerged in the metal liquid, the metal liquid level in the chamber may be always maintained at a preset height. Since metal has a relatively large density, in the case that the liquid level of the metal liquid is relatively high, the metal liquid at the traction head generates a relatively high pressure; under the action of the high pressure, the density of crystalline phase structure of the billets can increase, thereby enhancing quality of the billets; moreover, since the metal liquid level in the chamber may constantly maintain at the same height, the billet casting environment maintains constant, which may guarantee that the entire batch of billets has a high and stable quality. In addition, according to the Bernoulli principle, the higher the pressure, the greater the flow rate of fluid is affected; therefore, by maintaining a relatively high pressure, the metal liquid in the bottom layer may flow stably and smoothly, such that the metal liquid comprising extensive impurities does not easily flow upwards to affect billet quality.

The crystallizer further comprises a liquid level detecting device configured to detect a liquid level height of the metal liquid in the chamber, where the liquid level height of the metal liquid in the chamber may be determined by analyzing a detection signal of the liquid level detecting device, whereby the position of the immersion device can be timely adjusted, based on which the liquid level height of the metal liquid in the chamber is adjusted.

Furthermore, the immersion device comprises an immersion body and a lift rod connected to the immersion body, a drive for driving the lift rod to move up and down relative to the holding furnace being provided on the holding furnace. The drive may drive the lift rod to thereby bring the immersion body to perform an up-and-down movement, thereby adjusting the depth of the immersion body submerged in the metal liquid, further autonomously controlling the liquid level height of the metal liquid in the chamber.

Furthermore, the immersion body is hollow inside. By providing the immersion body with an inside hollow structure, the weight of the immersion body is reduced, whereby the load of the drive is reduced.

Furthermore, the crystallizer further comprises a furnace body and a cooling jacket disposed over the furnace body, the chamber being defined by the furnace body; the traction head draws the metal liquid from the inside of the cooling jacket such that the cooling jacket is cooled into a metal billet. After the metal liquid in the holding furnace accesses the chamber, it may be drawn out of the furnace body by the traction head; during this procedure, the metal liquid passes through the cooling jacket so as to be cooled thereby into a metal billet therein.

Furthermore, the lower end of the holding furnace communicates with the lower end of the furnace body, the bottom wall of the holding furnace is disposed lower than the bottom wall of the chamber. The metal liquid in the holding furnace enters, from the lower end thereof, the lower end of the crystallizer to supplement the metal liquid in the chamber. By providing the bottom wall of the holding furnace to be lower than the bottom wall of the chamber, the impurities deposited in the bottom layer of the metal liquid in the holding furnace do not easily access the inside of the crystallizer, which ensures that the compositions of the billets conform to billet manufacturing criteria.

Furthermore, the bottom wall of the holding furnace is gradually elevated towards the direction of the crystallizer, the bottom wall of the chamber is gradually lowered towards the direction of the holding furnace, the holding furnace and the crystallizer communicate via a fluid channel, and an end of the fluid channel connected to the holding furnace is gradually elevated towards another end of the fluid channel connected to the crystallizer. With this technical solution, flowing of the metal liquid from the holding furnace into the crystallizer is facilitated, preventing the circumstance that fierce fluctuation of the metal liquid causes extensive amounts of impurities to access the crystallizer with the metal liquid, such that the impurities in the holding furnace do not easily access the fluid channel, the impurities in the fluid channel do not easily access the crystallizer, and the impurities in the crystallizer do not easily flow upward with the metal liquid to be cast in the billets, whereby quality of the billets is enhanced.

Furthermore, an upper end of the holding furnace is provided with a metal liquid inlet communicating with the melting furnace, a bottom wall of the melting furnace has a metal liquid outlet communicating with the metal liquid inlet, and the bottom wall of the melting furnace at a side of the metal liquid outlet is recessed downward to form an impurity deposition sector. The metal liquid in the melting furnace exits the melting furnace via the metal liquid outlet and enters the holding furnace via the metal liquid inlet. During the melting procedure, the impurities with a density lower than the metal liquid likely float upward to the surface of the metal liquid, while the impurities with a density higher than the metal liquid may sink to the bottom layer, where the recessed impurity deposition sector may receive the sinking impurities, thereby reducing the amount of impurities included in the metal liquid around the metal liquid outlet, further reducing the content of impurities in the holding furnace; moreover, since the metal liquid outlet is disposed higher than the impurity deposition sector, during the procedure of feeding the metal liquid into the holding furnace, the metal liquid including extensive impurities in the impurity deposition sector do not easily access the holding furnace.

Furthermore, a first baffle plate is provided at a side of the holding furnace proximal to the metal liquid inlet, a gap for the metal liquid to flow is formed between the first baffle plate and the bottom wall of the holding furnace, and an end of a bottom portion of the holding furnace distal from the gap communicates with the chamber. The first baffle plate can baffle the metal liquid entering the holding furnace from the melting furnace so as to buffer the metal liquid, preventing a circumstance that the metal liquid in the holding furnace fluctuates fiercely to cause the impurities in the bottom layer to be diffused into the metal liquid with fluctuation of the metal liquid. After being baffled via the first baffle plate, the metal liquid flows out of the gap and mixed with the metal liquid in other parts of the holding furnace; since the gap is proximal to the bottom wall of the holding furnace, the pressure at the gap is relatively high, such that the metal liquid can flow stably and smoothly, reducing fluctuation of the metal liquid.

Furthermore, a second baffle plate is provided at a side of the melting furnace distal from the metal liquid outlet, a raw material inlet is enclosed between the second baffle plate and an end portion of the melting furnace, and the impurity deposition sector is located outside a projection range of the raw material inlet in the vertical direction. The second baffle plate can buffer the fluctuating metal liquid during the procedure of charging raw materials into the melting furnace, which mitigates the impact upon the metal liquid in the impurity deposition sector, while mitigation of fluctuation of the metal liquid there reduces upward diffusion of the impurities. Since the raw material inlet does not exactly face the impurity deposition sector, the charged raw materials do not directly sink into the impurity deposition sector, such that diffusion of the impurities is prevented.

Furthermore, the casting furnace featuring submerged, mechanical control of liquid level further comprises a double-acting switch valve, the double-acting switch valve comprising a mounting bracket and two mutually backup sealing assemblies disposed on the mounting bracket, each sealing assembly comprising a carbon rod and a carbon rod moving assembly, the carbon rod moving assembly being configured to translate, and elevate or lower the carbon rod so as to block or open the metal liquid outlet via the carbon rod. The sealing assemblies may block the metal liquid outlet via the carbon rod, holding the metal liquid in the melting furnace; after the metal liquid in the melting furnace is treated and settled, the sealing assembly opens the metal liquid outlet such that the metal liquid may be discharged into the holding furnace via the metal liquid outlet. Two sealing assemblies are provided and mutually replaceable, where when the carbon rod on one of the sealing assemblies is worn down, the other sealing assembly may take its place to block the metal liquid outlet again via the carbon rod; and then the worn-down carbon rod is renewed. This design eliminates the time taken for replacing the carbon rod and can reduce the amount of the metal liquid discharged via the metal liquid outlet during replacement of the carbon rod.

Furthermore, a third baffle plate is provided at the bottom wall of the holding furnace proximal to the crystallizer, one side of the third baffle plate facing the crystallizer is a flow guide surface skewing towards the crystallizer from top to bottom. Due to the baffling effect of the third baffle plate, when the metal liquid is replenished from the melting furnace into the holding furnace till the metal liquid level is higher than the third baffle plate, the metal liquid will flow over the third baffle plate to be thereby replenished into the chamber; the third baffle plate serves to baffle the impurities in the bottom layer of the holding furnace, thereby preventing the circumstance that during the procedure of replenishing the metal liquid, the metal liquid in the bottom layer of the holding furnace flows with extensive impurities accessing the chamber. The flow guide surface serves to guide and buffer the metal liquid, preventing the circumstance that fierce fluctuation of the metal liquid in the bottom layer of the chamber causes extensive impurities in the bottom layer to diffuse upward.

Furthermore, the third baffle plate is disposed lower than a cast center of the traction head, a plurality of through-holes spaced along the height direction being provided on the third baffle plate. Since the third baffle plate is disposed lower than the cast center of the traction head, the third baffle plate does not affect control of the liquid level height of the metal liquid in the chamber during continuous casting. The through-holes allow the metal liquid in the holding furnace to pass through the third baffle plate into the chamber, facilitating flowing of the metal liquid between the furnace body and the holding furnace. To replace the traction head, when the liquid level height of the metal liquid in the chamber drops below the cast center of the traction head, the immersion device is lifted such that the metal liquid in the chamber may pass through the third baffle plate and flow back into the holding furnace. Since the flow rate of the metal liquid flowing through the through-holes is limited, even if the through-holes are provided, the impurities in the holding furnace accessing the chamber through the through-holes are limited, and the impact on the quality of metal billets is small.

Furthermore, a plurality of immersion devices are provided, the plurality of immersion devices sequentially descending into the metal liquid during continuous casting. The volume of the chamber is smaller than that of the holding furnace; by providing a plurality of immersion devices, the liquid level height in the chamber is controlled by moving only one of the immersion devices up or down, whereby accuracy of liquid level control for the chamber can be enhanced.

Furthermore, the liquid level detecting device comprises a float ball, a floating rod connected to the float ball, and a sensor configured to detect displacement of the floating rod to determine liquid level height, a positioning mechanism being provided on the crystallizer, the positioning mechanism comprising at least two roller sets spaced along the vertical direction, each roller set comprising rollers that are pairwise disposed at two sides of the floating rod and roll with floating of the floating rod. The float ball may float and sink with fluctuation of the metal liquid level in the chamber so as to cause position change of the floating rod; the sensor may determine the liquid level height of the metal liquid in the chamber based on the position change of the floating rod. By providing the roller sets, the floating rod is movable along the vertical direction, preventing skewing of the floating rod from affecting determination on the liquid level height in the chamber.

The disclosure further provides a double-acting switch valve configured to control flowing of metal liquid between two metal liquid furnaces; the double-acting switch valve comprises two sealing assemblies which are mutually replaceable, where when the carbon rod on one of the sealing assemblies is worn down, the other sealing assembly may take its place to block the metal liquid outlet again via the carbon rod; and then the worn-down carbon rod is renewed. This design eliminates the time taken for replacing the carbon rod and can reduce the amount of the metal liquid discharged via the metal liquid outlet during replacement of the carbon rod.

Furthermore, the carbon rod moving assembly comprises a lift mechanism having a carbon rod clamping device, and a translational mechanism driving the lift mechanism to perform a translational movement; a metal liquid control position is provided on the mounting bracket; a sealing assembly resting at the metal liquid control position brings the carbon rod to move up or down via the lift mechanism to block or open the metal liquid channel between two metal liquid furnaces; the two sealing assemblies are symmetrically disposed; when the carbon rod of one of the sealing assemblies is worn down, the sealing assembly exits the metal liquid control position via cooperation between the lift mechanism and the translational mechanism, and the other one of the sealing assemblies moves to the metal liquid control position via cooperation between the lift mechanism and the translational mechanism. The carbon rod clamping device is configured to clamp the carbon rod, the lift mechanism is operable to control up-and-down movement of the carbon rod clamping device to thereby control up-and-down movement of the carbon rod to block or open the metal liquid channel, the translational mechanism is operable to control the lift mechanism to perform a translational movement such that the carbon rod translates to exit or access the metal liquid control position. When the carbon rod on one of the sealing assemblies is worn down, the carbon rod clamping device is first lifted via the lift mechanism of the sealing assembly, and then the translational mechanism drives the lift mechanism to translate to exit the metal liquid control position for renewing a complete carbon rod; after the translational mechanism of the other sealing assembly drives the lift mechanism to translate to access the metal liquid control position, the lift mechanism controls the carbon rod clamping device to descend such that the carbon rod blocks the metal liquid channel again.

Furthermore, the two sealing assemblies are disposed at a same side of the mounting bracket, each sealing assembly further comprising a sliding plate and a slide rail, the sliding plate being slidingly mounted on the slide rail, the lift mechanism being disposed on the sliding plate, the translational mechanism being disposed on the mounting bracket and configured to drive the sliding plate to slide along the slide rail. The lift mechanism mounted on the sliding plate may act synchronously with the sliding plate, and the translational mechanism may drive the sliding plate to slide along the slide rail, causing the lift mechanism to exit or access the metal liquid control position. By disposing the two sealing assemblies at a same side of the mounting bracket, the sealing assembly resting at the metal liquid control position may be switched only by the action of the translational mechanism.

Furthermore, the double-acting switch valve further comprises a carbon rod automatic replacing mechanism, the carbon rod automatic replacing mechanism comprising a housing, a reservoir provided in the housing, and a discharge port disposed on the housing and communicating with the reservoir, the carbon rod being stored in the reservoir and operable to fall off via the discharge port so as to be clamped by the carbon rod clamping device. The automatic carbon rod replacing mechanism can automatically renew the carbon rod on the sealing assembly exiting the metal liquid control position, eliminating a need of manual operation, thereby enhancing operation safety. Standby carbon rods are stored in the reservoir; when the carbon rod is mounted on the carbon rod clamping device, the carbon rod may fall off via the discharge port, whereby the carbon rod clamping device can clamp the carbon rod falling off via the discharge port.

Furthermore, the carbon rod clamping device is a hydraulically or pneumatically controlled clamping jaw; the clamping jaw releases the carbon rod exiting the metal liquid control position such that the carbon rod falls into the metal liquid furnace; the clamping jaw moves, under joint action of the lift mechanism and the translational mechanism, till beneath the discharge port to clamp the carbon rod. The clamping jaw may be hydraulically or pneumatically controlled to automatically release or clamp the carbon rod, thereby eliminating a need of manually disassembling and assembling the carbon rod. When the carbon rod is worn down, the clamping jaw may release the carbon rod to allow the carbon rod to fall into the metal liquid, without a need of collecting the worn-down carbon rods, which may eliminate provision of a device for automatically collecting the worn-down carbon rods.

Furthermore, the carbon rod comprises a carbon rod body and a large-diameter segment at an upper end of the carbon rod body; the discharge port comprises a first discharge port and a second discharge port, a size of the first discharge port being smaller than that of the large-diameter segment, a size of the second discharge port being greater than that of the large-diameter segment; when the carbon rod falls off via the first discharge port, the large-diameter segment abuts against the housing around the first discharge port; a through groove mutually communicating with the first discharge port and the second discharge port is disposed therebetween; the carbon rod clamping device is operable to bring the clamped carbon rod to the second discharge port so as to be detached from the housing. During the procedure of mounting the carbon rod, the carbon rod first falls off via the first discharge port, after the carbon rod falls a certain distance, the large-diameter segment abuts against the housing around the first discharge port to be thereby kept at the first discharge port, which prevents the carbon rod from falling from the automatic carbon rod replacing mechanism. When the carbon rod on the sealing assembly at the metal liquid control position is worn down, the other sealing assembly with the carbon rod being completely mounted moves till the metal liquid control position, during this procedure, the carbon rod clamping device brings the carbon rod to move relative to the housing, causing the carbon rod to move to the second discharge port along the through groove; since the size of the second discharge port is larger than that of the large-diameter segment, descending of the carbon rod clamping device brings the carbon rod to descend along therewith, thereby blocking the metal liquid channel.

Furthermore, the carbon rod further comprises a small-diameter segment with a size greater than the carbon rod body, the small-diameter segment being disposed below the large-diameter segment, a clamped segment for being clamped by the carbon rod clamping device being formed between the small-diameter segment and the large-diameter segment, the size of the small-diameter segment being smaller than the first discharge port. The small-diameter segment may pass through the first discharge port smoothly without being blocked, such that the clamped segment may project out of the housing so as to be clamped by the carbon rod clamping device; when the carbon rod blocks the metal liquid channel, the carbon rod is subjected to an upward counterforce, and via cooperation between the small-diameter segment and the carbon rod clamping device, relative displacement between the carbon rod and the carbon rod clamping device in the axial direction may be avoided, thereby preventing leakage of the metal liquid channel.

Furthermore, the mounting bracket comprises a fixed mounting bracket and a rotary mounting bracket rotatably mounted on the fixed mounting bracket, the two sealing assemblies being disposed at two sides of the rotary mounting bracket, respectively, the two sealing assemblies being symmetrical relative to a rotating axis center of the rotary mounting bracket, the housing being fixedly connected to the fixed mounting bracket, a drive motor configured to drive the rotary mounting bracket to rotate being provided at the bottom of the housing, the rotary mounting bracket bringing the sealing assembly to rotate such that the carbon rod moves from the first discharge port to the second discharge port. The drive motor may drive the rotary mounting bracket to rotate relative to the fixed mounting bracket so as to adjust the relative position between the two sealing assemblies, such that the two sealing assemblies may obtain a new carbon rod from the same first discharge port; alternatively, only one reservoir may be provided in the housing. When the rotary mounting bracket is rotating, the carbon rod clamping device brings the carbon rod to act synchronously to enable the carbon rod to move from the first discharge port to the second discharge port.

Furthermore, a limit plate and a drive mechanism driving the limit plate to slide are slidingly mounted below the first discharge port. The limit plate may block the carbon rod from falling off, avoiding a circumstance that the carbon rod already projects out of the housing and blocks movement of the carbon rod clamping device before the carbon rod clamping device moves below the first discharge port; the drive mechanism may control movement of the limit plate so as to remove blockage to the carbon rod; the drive mechanism can also reset the limit plate after the carbon rod is moved by the carbon rod clamping device, thereby resuming the blockage to the carbon rod in the reservoir.

Furthermore, an elastic pressing plate configured to push the carbon rod to move towards the direction of the discharge port is provided in the reservoir, one end of the reservoir proximal to the discharge port is gradually shrunk towards the direction of the discharge port, a bottom wall of the end of the reservoir proximal to the discharge port is gradually inclined downwardly. The elastic pressing plate may automatically push the carbon rod to move towards the direction of the first discharge port such that the carbon rod may automatically fall off via the first discharge port without interruption; by providing the end portion of the reservoir to be gradually shrunk, the number of carbon rods simultaneously passing therethrough may be limited, preventing two carbon rods from simultaneously blocking the first discharge port; in addition, since the end portion of the reservoir is shrunk, the elastic pressing plate cannot project thereinto, and by providing the bottom wall of this portion to be inclined, the carbon rod may automatically slide towards the direction of the first discharge port without being pushed.

The above and other features and advantages of the disclosure will be described in further detail through example embodiments with reference to the drawings.

BRIEF DESCRIPTION OF THE DRAWINGS

Hereinafter, the disclosure will be illustrated in further detail with reference to the accompanying drawings.

Figure 1:
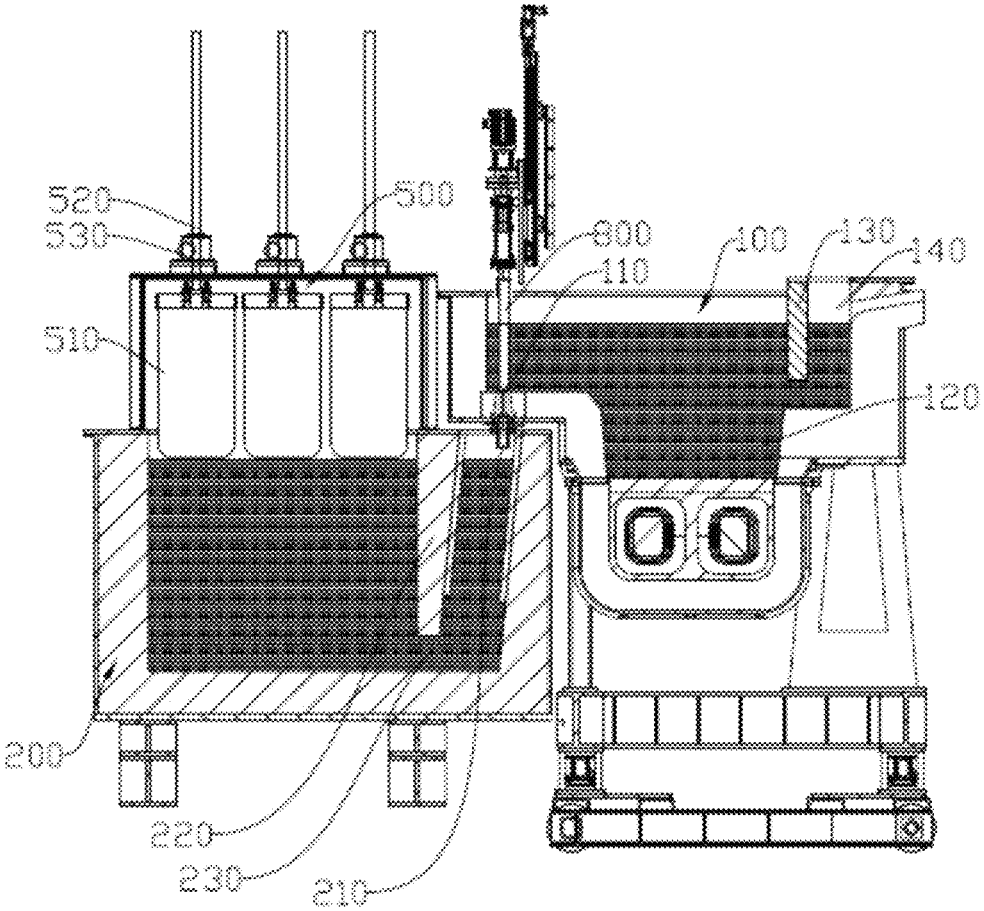
FIG. 1 is a structural schematic diagram of a melting furnace and a holding furnace in some embodiments of the disclosure.

REFERENCE NUMERALS melting furnace 100, metal liquid outlet 110, impurity deposition sector 120, second baffle plate 130, raw material inlet 140;

holding furnace 200, metal liquid inlet 210, first baffle plate 220, gap 230, third baffle plate 240, flow guide surface 250, through-hole 260;

crystallizer 300, chamber 301, furnace body 302, cooling jacket 310;

traction head 400;

immersion device 500, immersion body 510, lift rod 520, drive 530;

liquid level detecting device 600, float ball 610, floating rod 620, roller set 630;

fluid channel 700;

carbon rod 800, carbon rod body 810, large-diameter segment 820, small-diameter segment 830, clamped segment 840, elastic pressing plate 850, pressing plate body 851, spring 852, limit plate 860, connecting column 870;

mounting bracket 900, slide rail 901, sliding plate 902, fixed mounting bracket 903, rotary mounting bracket 904, drive motor 905, carbon rod clamping device 910, lift mechanism 911, translational mechanism 912, housing 920, reservoir 921, first discharge port 922, second discharge port 923, through groove 924, cushioning pad 925.

DETAILED DESCRIPTION

Hereinafter, the technical solutions of the disclosure will be explained and described through example embodiments with reference to the accompanying drawings. It is noted that the example embodiments described infra are only preferred examples, not the entirety of the embodiments of the disclosure. All other embodiments derived by those skilled in the art based on the example embodiments without exercise of inventive efforts shall fall within the scope of protection of the disclosure.

The terms "exemplary" and "some example embodiments" appearing infra mean "used as an example, an example implementation, or an illustration," and any embodiment described in an "exemplary" way is not necessarily interpreted as preferred over or better than other example implementations. To better illustrate the disclosure, various details are provided in the example embodiments below, and those skilled in the art shall appreciate that the disclosure can also be implemented without some details thereof.

Referring to FIGS. 1 to 5, embodiments of the disclosure provide a casting furnace featuring submerged, mechanical control of liquid level, comprising: a melting furnace 100, a holding furnace 200, and a crystallizer 300, the crystallizer 300 comprising a chamber 301 for accommodating metal liquid, the holding furnace 200 being communicating with the melting furnace 100 and the chamber 301, the chamber 301 maintaining communication with the holding furnace 200, a traction head 400 being provided on the crystallizer 300, wherein the melting furnace 100 is configured to melt raw materials into metal liquid and treat the metal liquid such that compositions thereof conform to billet manufacturing criteria, the holding furnace 200 is configured to hold the treated metal liquid and supply the metal liquid to the chamber 301, and the traction head 400 is attached to the crystallizer 300, and the traction head 400 is configured to draw the metal liquid from the crystallizer 300 into a tubular blank or a billet stand.

When the metal liquid level in the chamber 301 drops below the center of the traction head 400, billet production is interrupted. The holding furnace 200 is provided with a liftable immersion device 500; the immersion device 500 can perform an up-and-down movement so as to be submerged into the metal liquid in the holding furnace 200, thereby elevating the metal liquid level in the holding furnace 200; since the holding furnace 200 is in communication with the chamber 301, elevation of the metal liquid level in the holding furnace 200 can also lead to elevation of the metal liquid level in the chamber 301; this may improve utilization of the metal liquid in the holding furnace 200 and reduce the replenishing frequency of the metal liquid, thereby improving productivity. In addition, if the casting furnace becomes scrapped, the residual metal liquid in the furnace may also be reduced, thereby reducing economic loss.

To replace the traction head 400, a conventional approach is to tilt the crystallizer to cause the metal liquid level to be lower than the entire traction head, to ensure that the metal liquid does not flow out during the process of replacing the traction head; however, in the solution of the disclosure, it is only needed to control the immersion device 500 to be submerged into the metal liquid, and lift the immersion device 500 after most of the metal liquid has been drawn; in this way, the metal liquid level in the chamber 301 can drop below the traction head 400, thereby facilitating replacement of the traction head 400.

The crystallizer 300 further comprises a furnace body 302 and a cooling jacket 310 disposed over the furnace body 302, the chamber 301 being defined by the furnace body 302, the cooling jacket 310 communicating with the chamber 301, the traction head 400 being disposed in the cooling jacket 310; the traction head 400 comprises a mold and a traction rod, the mold being mounted in the cooling jacket 310, the traction rod being movable relative to the mold; the traction rod can block the area where the cooling jacket 310 is connected to the furnace body 302. During the production process, when the traction rod moves, the metal liquid may flow out gradually to access between the mold and the cooling jacket 310, where the metal liquid is cooling-formed by the cooling jacket 310; during the cooling procedure of the metal liquid, the traction rod is connected to the front end of the metal billet, whereby the metal billet is drawn; thereafter, the front end of the metal billet is cut off to remove the traction rod; finally, the traction device disposed rear to the crystallizer draws the metal billet; in this way, the metal liquid is uninterruptedly cooled into metal billets.

A cooling channel is provided in the cooling jacket 310, available for a cooling liquid or cooling air passing through to thereby exchange heat with the metal liquid, whereby the metal liquid is cooled into a metal billet. The mold in the traction head 400 is configured to define shape, type, and size of the metal billet, where the shape, type, and size of the metal billets to produce may be adjusted by changing the mold.

The crystallizer 300 further comprises a liquid level detecting device 600 configured to detect a liquid level height of the metal liquid in the chamber 301, where the liquid level height of the metal liquid in the chamber 301 may be determined by analyzing a detection signal of the liquid level detecting device 600, whereby the position of the immersion device 500 can be timely adjusted, based on which the liquid level height of the metal liquid in the chamber 301 is adjusted to keep the liquid level inside the chamber 301 at a preset height. Since metal has a relatively large density, in the case that the liquid level of the metal liquid is relatively high, the metal liquid at the traction head 400 generates a relatively high pressure; under the action of the high pressure, the density of crystalline phase structure of the billets can increase, thereby enhancing quality of the billets; moreover, since the metal liquid level in the chamber 301 may constantly maintain at the same height, the billet casting environment maintains constant, which may guarantee that the entire batch of billets has a high and stable quality. In addition, according to the Bernoulli principle, the higher the pressure, the greater the flow rate of fluid is affected; therefore, by maintaining a relatively high pressure, the metal liquid in the bottom layer may flow stably and smoothly, such that the metal liquid comprising extensive impurities does not easily flow upwards to affect billet quality.

During the production process, after the immersion device 500 descends to the lowest position, which means the metal liquid level in the chamber 301 will decrease gradually; in this case, metal liquid may be replenished from the melting furnace 100 into the holding furnace 200; during the metal liquid replenishing procedure, the immersion device 500 resets upward gradually, instead of first elevating the immersion device 500 and then replenishing the metal liquid; this practice may prevent such circumstance that since the metal liquid level in the holding furnace 200 is too low, replenishing of the metal liquid likely impacts the metal liquid in the holding furnace 200 to cause fierce fluctuation bringing the impurities deposited at the bottom layer to diffuse upward. During this procedure, the lifting velocity of the immersion device 500 is controlled based on the detection signal of the liquid level detecting device 600, whereby the liquid level height of the metal liquid in the chamber 301 is maintained.

Figure 2:
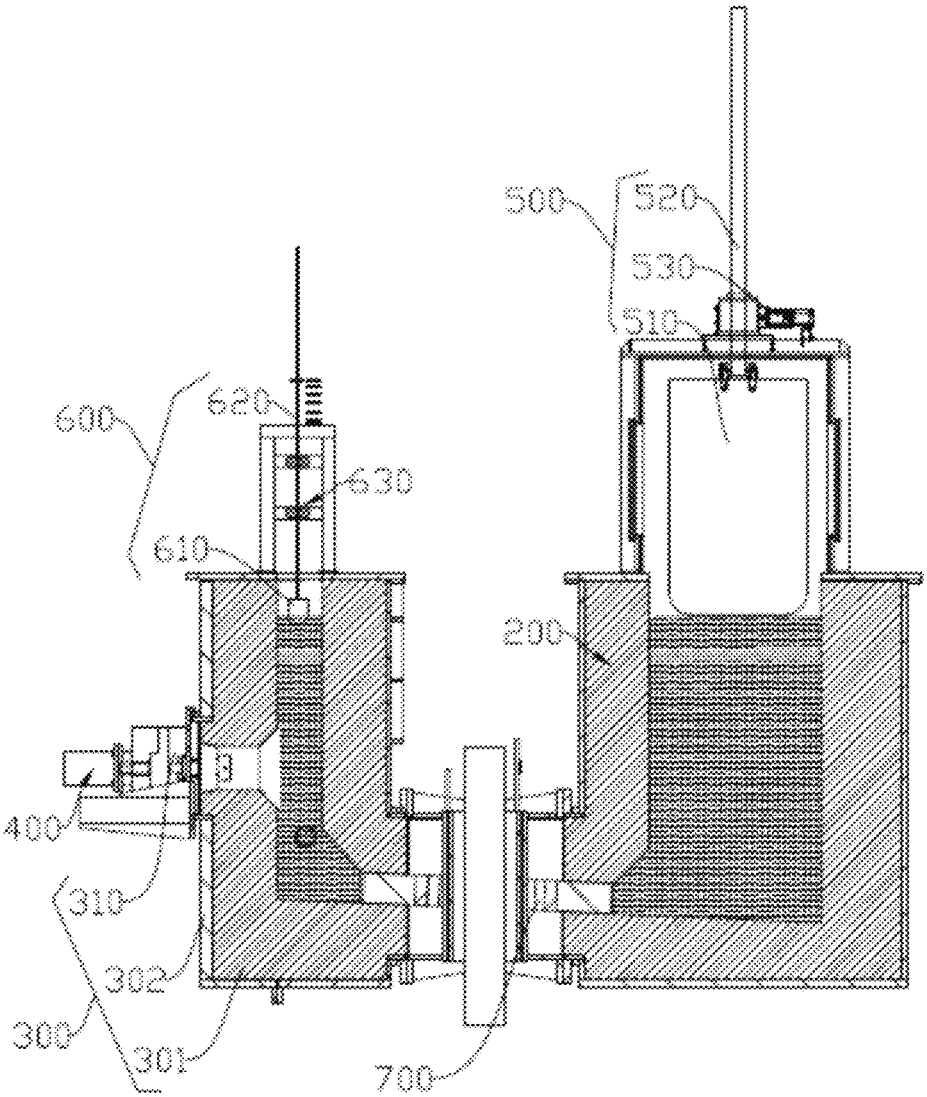
FIG. 2 is a structural schematic diagram of the holding furnace and a crystallizer in some embodiments of the disclosure.
Figure 3:
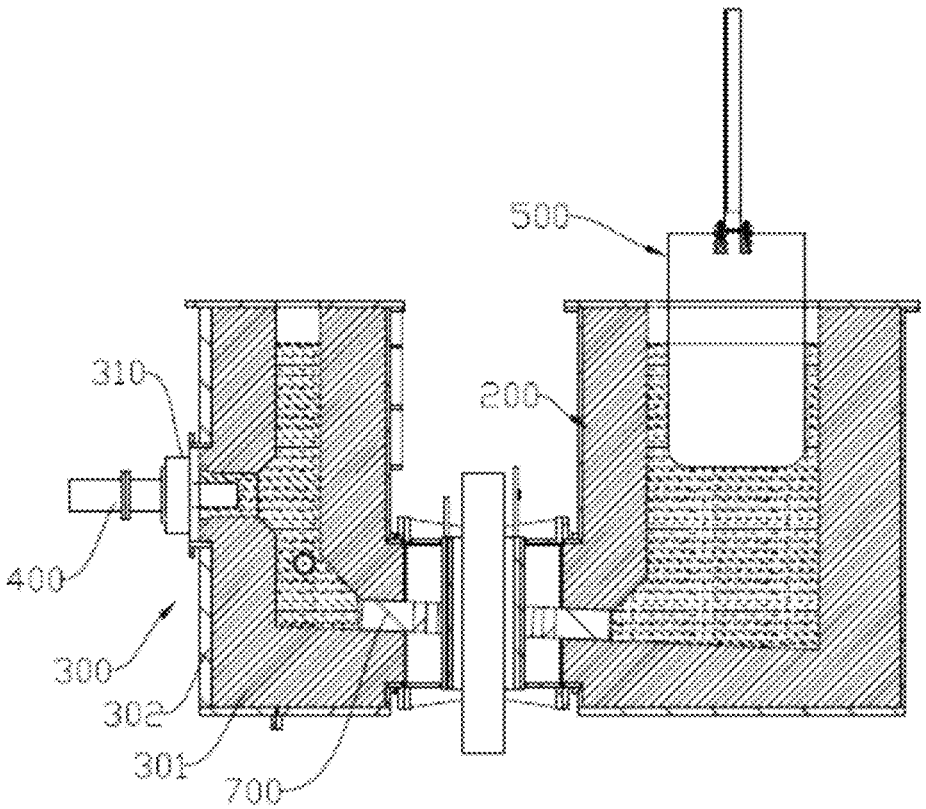
FIG. 3 is a structural schematic diagram of the holding furnace and the crystallizer when an immersion device is submerged into the holding furnace in some embodiments of the disclosure.
Figure 4:
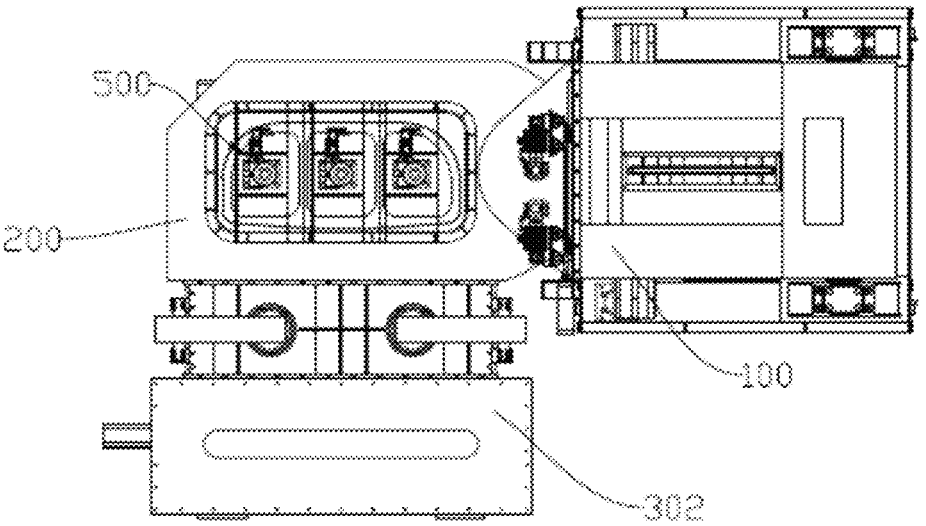
FIG. 4 is a top view of a casting furnace in some embodiments of the disclosure.

Referring to FIGS. 2 and 3, based on the example embodiment described supra, in an implementation of the disclosure, the lower end of the holding furnace 200 and the lower end of the furnace body 302 communicate via a fluid channel 700, such that the metal liquid in the holding furnace 200 enters from the lower end thereof into the lower end of the furnace body 302, thereby replenishing the metal liquid in the chamber 301; to guarantee quality of the metal liquid in the chamber 301, the bottom wall of the holding furnace 200 is disposed lower than the bottom wall of the chamber 301, such that the impurities deposited in the bottom layer of the metal liquid do not easily access the inside of the chamber 301; in this way, it is ensured that the compositions of the billets conform to billet manufacturing criteria.

The bottom wall of the holding furnace 200 is gradually elevated towards the direction of the furnace body 302, such that the impurities in the holding furnace 200 do not easily access the fluid channel 700; the fluid channel 700 connected to the holding furnace 200 is gradually elevated towards the end connected to the furnace body 302, such that the impurities in the fluid channel 700 do not easily access the furnace body 302; the bottom wall of the chamber 301 is gradually lowered towards the direction of the holding furnace 200, such that the impurities in the chamber 301 do not easily flow upward with the metal liquid to be cast into the billets, thereby enhancing quality of the billets. The bottom wall of the holding furnace 200 and the bottom wall of the chamber 301 are both of a beveled structure; under joint action of the above three implementations, flowing of the metal liquid from the holding furnace 200 towards the inside of the furnace body 302 is facilitated, avoiding the circumstance that due to fierce fluctuation of the metal liquid, extensive impurities enter the furnace body 302 along with the metal liquid.

The upper end of the holding furnace 200 is provided with a metal liquid inlet 210 in communication with the melting furnace 100, the bottom wall of the melting furnace 100 is provided with a metal liquid outlet 110 in communication with the metal liquid inlet 210, such that the metal liquid in the melting furnace 100 exits the melting furnace 100 via the metal liquid outlet 110 and then enters the holding furnace 200 via the metal liquid inlet 210. The holding furnace and the melting furnace are connected via a fluid guiding connector, where the metal liquid inlet and the metal liquid outlet are interfaced with two ends of the fluid guiding connector, respectively, and a metal liquid channel for the metal liquid to flow through is further provided in the fluid guiding connector.

A first baffle plate 220 is provided at the side of the holding furnace 200 proximal to the metal liquid inlet 210, a gap 230 for the metal liquid to flow is defined by the first baffle plate 220 and the bottom wall of the holding furnace 200; the end of the bottom of the holding furnace 200 distal from the gap 230 is in communication with the furnace body 302. The first baffle plate 220 is operable to baffle the metal liquid entering the holding furnace 200 from the melting furnace 100 to thereby buffer the metal liquid, preventing the circumstance that due to fierce fluctuation of the metal liquid in the holding furnace 200, the impurities in the bottom layer are diffused in the metal liquid with fluctuation of the metal liquid. After being baffled via the first baffle plate 220, the metal liquid flows out of the gap 230 and mixed with the metal liquid in other parts of the holding furnace 200; since the gap 230 is proximal to the bottom wall of the holding furnace 200, the pressure at the gap 230 is relatively high, such that the metal liquid can flow stably and smoothly, reducing fluctuation of the metal liquid.

Figure 6:
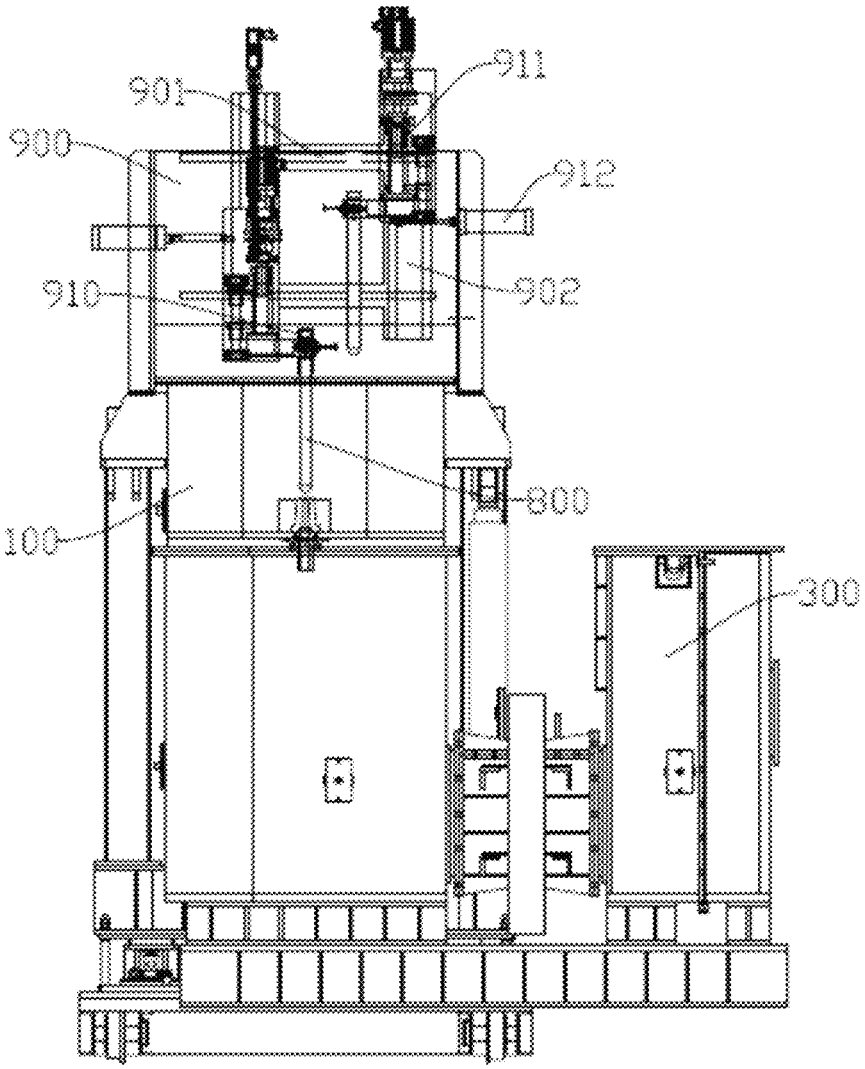
FIG. 6 is a structural schematic diagram of a melting furnace and a double-acting switch valve in some embodiments of the disclosure.

Referring to FIG. 6, based on the example embodiments described supra, in an implementation of the disclosure, the casting furnace featuring submerged, mechanical control of liquid level further comprises a double-acting switch valve, the double-acting switch valve comprising a mounting bracket 900 and two mutual-backup seal assemblies disposed on the mounting bracket 900, each sealing assembly comprises a carbon rod 800 and a carbon rod moving assembly, the carbon rod moving assembly being operable to translate and elevate or lower the carbon rod 800 so as to block or open the metal liquid outlet 110 via the carbon rod 800. The sealing assembly may block the metal liquid outlet 110 via the carbon rod, holding the metal liquid in the melting furnace 100; after the metal liquid in the melting furnace 100 is treated and settled, the sealing assembly opens the metal liquid outlet 110 such that the metal liquid may be discharged into the holding furnace 200 via the metal liquid outlet 110. Two sealing assemblies are provided and mutually replaceable, where when the carbon rod 800 on one of the sealing assemblies is worn down, the other sealing assembly may take its place to block the metal liquid outlet 110 again via the carbon rod 800; and then the worn-down carbon rod 800 is renewed. This design eliminates the time taken for replacing the carbon rod 800 and can reduce the amount of the metal liquid discharged via the metal liquid outlet 110 during replacement of the carbon rod 800.

In the disclosure, the metal liquid refers to copper liquid, and the carbon rod 800 refers to a graphite rod. The graphite rod is a consumable; besides the function of blocking the metal liquid outlet 110, the graphite rod can also conduct a redox reaction with the copper oxide in the copper liquid, whereby the oxygen turns into carbon monoxide to be separated from the copper liquid, reducing oxygen content in the billets. The graphite rod is a consumable, which may be quickly assembled, disassembled, and replaced by holding and screw-fitting, etc.

Referring to FIG. 1, based on the example embodiments described supra, in an implementation of the disclosure, the bottom wall of the melting furnace 100 at the metal liquid outlet 110 side is recessed downward to form an impurity deposition sector 120. When the raw materials are melted in the melting furnace 100, the impurities with a density lower than the metal liquid likely float upward to the surface of the metal liquid, while the impurities with a density higher than the metal liquid may sink to the bottom layer; other insignificant compositions dissolved in the metal liquid may be treated by for example adding an oxidizing agent or a metallic compound to the metal liquid to reduce their contents; the recessed impurity deposition sector 120 may receive the sinking impurities which are not dissolved in the metal liquid and have a density greater than the metal liquid, thereby reducing the amount of impurities included in the metal liquid around the metal liquid outlet 110, further reducing the content of impurities in the holding furnace 200; moreover, since the metal liquid outlet 110 is disposed higher than the impurity deposition sector 120, during the procedure of feeding the metal liquid into the holding furnace 200, the metal liquid including extensive impurities in the impurity deposition sector 120 do not easily access the holding furnace 200.

A second baffle plate 130 is provided at one side of the melting furnace 100 distal from the metal liquid outlet 110, a raw material inlet 140 being enclosed between the second baffle plate 130 and an end portion of the melting furnace 100, the impurity deposition sector 120 being located outside the projection range of the raw material inlet 140 in the vertical direction. The second baffle plate 130 can buffer the fluctuating metal liquid during the procedure of charging raw materials into the melting furnace 100, which mitigates the impact upon the metal liquid in the impurity deposition sector 120, while mitigation of fluctuation of the metal liquid reduces upward diffusion of the impurities. Since the raw material inlet 140 does not exactly face the impurity deposition sector 120, the charged raw materials do not directly sink into the impurity deposition sector 120, such that diffusion of the impurities is prevented.

Referring to FIGS. 1 to 3, based on the example embodiments described supra, in an implementation of the disclosure, the immersion device 500 comprises an immersion body 510 and a lift rod 520 connected to the immersion body 510; a drive 530 operable to drive the lift rod 520 to perform an up-and-down movement relative to the holding furnace 200 is provided on the holding furnace 200.

In one example implementation, the immersion body 510 is hollow inside, which may reduce weight while guaranteeing the size, thereby reducing the load on the drive 530 as well as the cost of the immersion body 510.

In addition, compared with the holding furnace 200, the chamber 301 has a smaller volume; to enhance accuracy of liquid level control, a plurality of immersion devices 500 are provided; during the continuous casting process, the plurality of immersion devices 500 gradually descend into the metal liquid. By providing a plurality of immersion devices 500, the liquid level height in the chamber 301 is controlled by moving only one of the immersion devices 500 up or down, whereby accuracy of liquid level control for the chamber 301 can be enhanced.

The drive 530 may refer to one of electric motor, hydraulic cylinder, or electric actuator.

Referring to FIG. 2, based on the example embodiments described supra, in an implementation of the disclosure, the liquid level detecting device 600 comprises a float ball 610, a floating rod 620 connected to the float ball 610, and a sensor for detecting displacement of the floating rod 620 to determine the liquid level height; a positioning mechanism is provided on the crystallizer 300, the positioning mechanism comprising at least two roller sets 630 spaced along the vertical direction, each roller set 900 comprises rollers which are pairwise disposed at two sides of the floating rod 620 and roll with floating of the floating rod 620. The float ball 610 may float and sink with fluctuation of the metal liquid level in the chamber 301 so as to cause position change of the floating rod 620; the sensor may determine the liquid level height of the metal liquid in the chamber 301 based on position change of the floating rod 620. By providing the roller sets 630, the floating rod 620 is movable along the vertical direction, preventing skewing of the floating rod 620 from affecting determination on the liquid level height in the chamber 301.

Figure 5:
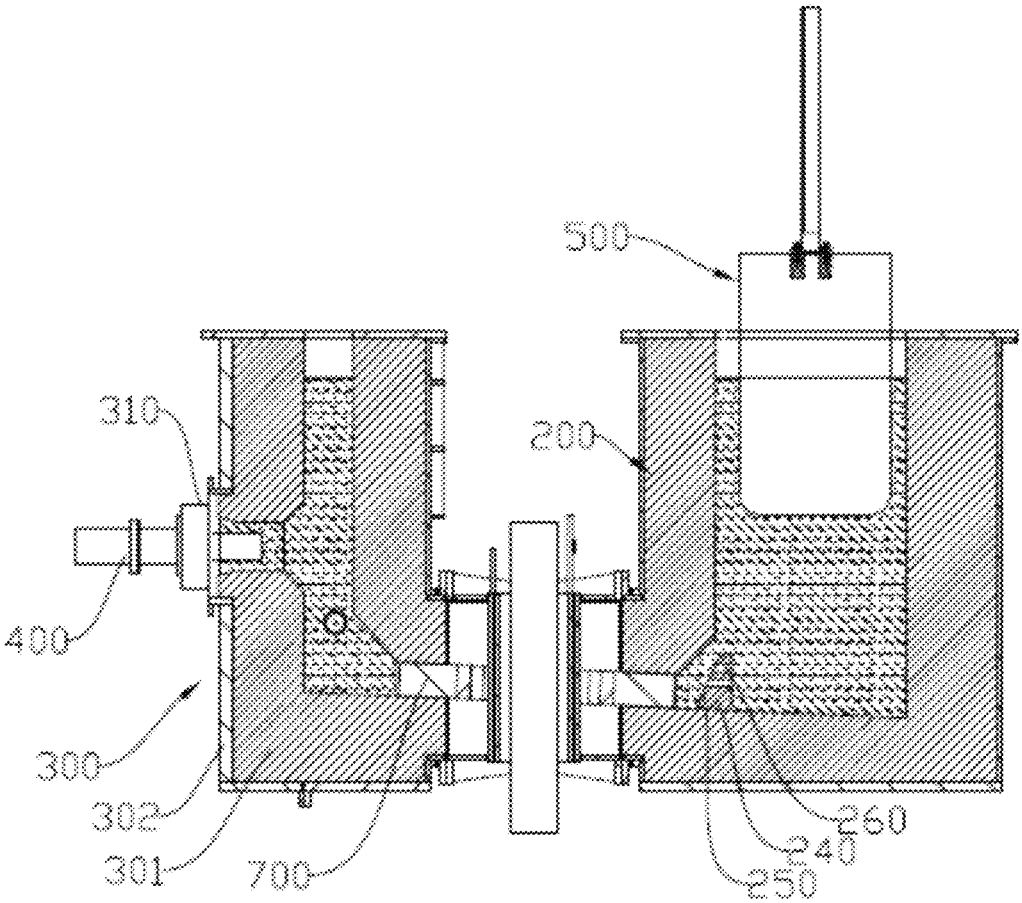
FIG. 5 is a structural schematic diagram of a holding furnace with a third baffle plate in some embodiments of the disclosure.

Referring to FIG. 5, based on the example embodiments described supra, in an implementation of the disclosure, a third baffle plate 240 is provided at the bottom wall of the holding furnace 200 proximal to the side of the furnace body 302, the side of the third baffle plate 240 facing the furnace body 302 is a flow guide surface 250 skewing towards the furnace body 302 from top to bottom. Due to the baffling effect of the third baffle plate 240, when the metal liquid is replenished from the melting furnace 100 into the holding furnace 200 till the metal liquid level is higher than the third baffle plate 240, the metal liquid will flow over the third baffle plate 240 to be thereby replenished into the chamber 301; the third baffle plate 240 serves to baffle the impurities in the bottom layer of the holding furnace 200, thereby preventing the circumstance that during the procedure of replenishing the metal liquid, the metal liquid in the bottom layer of the holding furnace 200 flows with extensive impurities accessing the chamber 301. The flow guide surface 250 serves to guide and buffer the metal liquid, preventing the circumstance that fierce fluctuation of the metal liquid in the bottom layer of the chamber 301 causes extensive impurities in the bottom layer to diffuse upward. The flow guide surface 250 refers to a beveled surface tilting towards the furnace body 302, and the lower end of the flow guide surface 250 is closer to the furnace body 302 so as to be capable of guiding and buffering the metal liquid towards the furnace body 302. In addition, the flow guide surface may also be provided as an arc-shaped surface.

During a normal continuous casting process, when the liquid level height of the metal liquid in the chamber 301 drops below the cast center of the traction head 400, it is needed to replenish metal liquid into the holding furnace 200 in time so as to elevate the liquid level height of the metal liquid in the chamber 301; in order not to affect control of the liquid level height of the metal liquid in the chamber 301, the third baffle plate 240 is disposed lower than a cast center of the traction head 400.

A plurality of through-holes 260 arranged at intervals along the height direction are further provided on the third baffle plate 240; the through-holes 260 allow the metal liquid in the holding furnace 200 to pass through the third baffle plate 240 into the chamber 301, facilitating flowing of the metal liquid between the furnace body 302 and the holding furnace 200. To replace the traction head 400, when the liquid level height of the metal liquid in the chamber 301 drops below the cast center of the traction head 400, the immersion device is lifted such that the metal liquid in the chamber 301 may pass through the third baffle plate 240 and flow back into the holding furnace 200. Since the flow rate of the metal liquid flowing through the through-holes 260 is limited, even if the through-holes 260 are provided, the impurities in the holding furnace 200 accessing the chamber 301 through the through-holes 260 are limited, having little impact on the quality of metal billets.

Referring to FIGS. 6-11, the disclosure further provides a double-acting switch valve, comprising a mounting bracket 900 and two mutually backup sealing assemblies disposed on the mounting bracket 900, each sealing assembly comprising a carbon rod 800 and a carbon rod moving assembly, the carbon rod moving assembly being configured to translate, and elevate or lower the carbon rod 800 so as to block or open the metal liquid channel between the two metal liquid furnaces via the carbon rod 800.

In the field of the disclosure, horizontal continuous casting furnace installation comprises a melting furnace for melting metal material, and a holding furnace for holding the metal liquid, both melting furnace and holding furnace are able to hold the metal liquid. The double-acting switch valve of the disclosure is used for blocking or opening a metal liquid channel between melting furnace and holding furnace, but its usage is not limited to melting furnace and holding furnace also applicable for other furnaces from the horizontal continuous casting furnace installation which are able to hold the metal liquid. And those furnaces, including melting furnace and holding furnace, are known as metal liquid furnaces.

Specifically, the sealing assembly comprises a lift mechanism 911 having a carbon rod clamping device 910, and a translational mechanism 912 driving the lift mechanism 911 to perform a translational movement, a metal liquid control position being provided on the mounting bracket 900 corresponding to the metal liquid channel (as illustrated in FIG. 6, the sealing assembly at the left side of FIG. 6 rests at the metal liquid control position); the sealing assembly resting at the metal liquid control position brings the carbon rod 800 to lift via the lift mechanism 911 so as to block or open the metal liquid channel; the two sealing assemblies are symmetrically disposed, such that when the carbon rod 800 of one of the sealing assemblies is worn down, it exits the metal liquid control position via cooperation between the lift mechanism 911 and the translational mechanism 912, and then the other one of the sealing assemblies moves to the metal liquid control position via cooperation between the lift mechanism 911 and the translational mechanism 912.

The double-acting switch valve comprises two sealing assemblies, each of the two sealing assemblies being provided with a lift mechanism 911, a translational mechanism 912, and a carbon rod clamping device 910, the carbon rod clamping device 910 being configured to clamp the carbon rod 800, the lift mechanism 911 being operable to control up-and-down movement of the carbon rod clamping device 910 to thereby control up-and-down movement of the carbon rod 800 to block or open the metal liquid channel, the translational mechanism 912 being operable to control the lift mechanism 911 to perform a translational movement such that the carbon rod 800 translates to exit or access the metal liquid control position. The two assembly components are mutually replaceable; when the carbon rod 800 on one of the sealing assemblies is worn down, the carbon rod clamping device 910 is first lifted via the lift mechanism 911 of the sealing assembly, and then the translational mechanism 912 drives the lift mechanism 911 to translate to exit the metal liquid control position for renewing a complete carbon rod 800; after the translational mechanism 912 of the other sealing assembly drives the lift mechanism 911 to translate to access the metal liquid control position, the lift mechanism 911 controls the carbon rod clamping device 910 to descend such that the carbon rod 800 blocks the metal liquid channel again. This design may eliminate the time taken for waiting for renewal of the carbon rod 800 and reduce the amount of the metal liquid discharged from the metal liquid channel during renewal of the carbon rod 800.

Referring to FIG. 6, based on the example embodiments described supra, in an implementation of the disclosure, the two sealing assemblies are disposed at a same side of the mounting bracket 900; each sealing assembly further comprises a sliding plate 902 and a slide rail 901, the sliding plate 902 being slidingly mounted on the slide rail 901, the lift mechanism 911 being disposed on the sliding plate 902, the translational mechanism 912 being disposed on the mounting bracket 900 to drive the sliding plate 902 to slide along the slide rail 901. The lift mechanism 911 mounted on the sliding plate 902 may act synchronously with the sliding plate 902, and the translational mechanism 912 may drive the sliding plate 902 to slide along the slide rail 901, causing the lift mechanism 911 to exit or access the metal liquid control position.

When the lift mechanism 911 exits the metal liquid control position, the carbon rod 800 may be disassembled and assembled manually.

The translational mechanism 912 and the lift mechanism 911 may be powered by an air cylinder or an electric motor.

Figure 11:
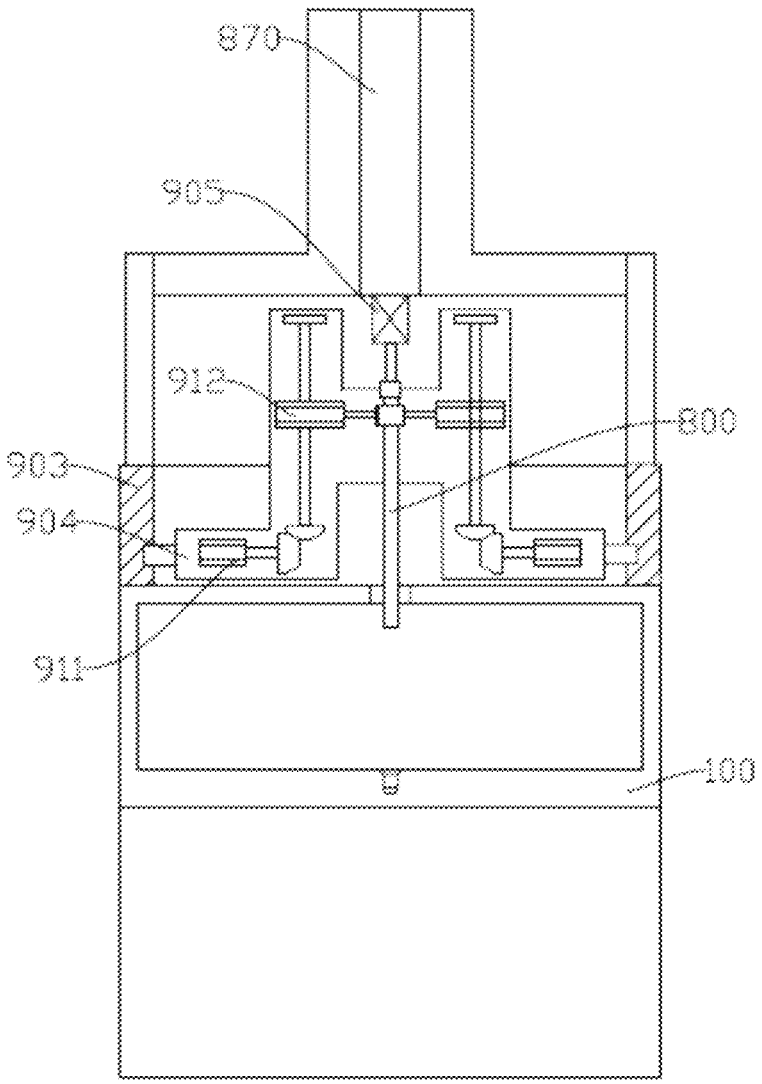
FIG. 11 is a structural schematic diagram of a melting furnace and an alternative double-acting switch valve in some embodiments of the disclosure.

As illustrated in FIG. 11, the disclosure provides a lift mechanism comprising an electric motor and a screw rod, a bevel gear being applied between the electric motor and the screw rod to rotate, the screw rod and the translational mechanism 912 being thread-fitted, such that when the screw rod is rotating, the translational mechanism 912 is movable along the screw rod.

Referring to FIGS. 7 to 11, based on the example embodiments described supra, in an implementation of the disclosure, the double-acting switch valve further comprises an automatic carbon rod replacing mechanism, the automatic carbon rod replacing mechanism comprising a housing 920, a reservoir 921 provided in the housing 920, and a discharge port which is disposed on the housing 920 and communicates with the reservoir 921; the carbon rod 800 is stored in the reservoir 921 and may fall off via the discharge port so as to be clamped by the carbon rod clamping device 910. The automatic carbon rod replacing mechanism can automatically renew the carbon rod 800 on the sealing assembly exiting the metal liquid control position, eliminating a need of manual operation, thereby enhancing operation safety. Standby carbon rods 800 are stored in the reservoir 921; when the carbon rod 800 is mounted on the carbon rod clamping device 910, the carbon rod 800 may fall off via the discharge port, whereby the carbon rod clamping device 910 can clamp the carbon rod 800 falling off via the discharge port.

In the disclosure, the metal liquid refers to copper liquid and the carbon rod 800 refers to a graphite rod. The graphite rod is a consumable; in addition to the functionality of blocking the metal liquid channel, the graphite rod can also conduct a redox reaction with the copper oxide in the copper liquid, whereby the oxygen turns into carbon monoxide to be separated from the copper liquid, reducing oxygen content in the billets.

The carbon rod clamping device 910 is a hydraulically or pneumatically controlled clamping jaw; the clamping jaw releases the carbon rod 800 exiting the metal liquid control position such that the carbon rod 800 falls into the metal liquid furnaces; the clamping jaw moves, under joint action of the lift mechanism 911 and the translational mechanism 912, till beneath the discharge port to clamp the carbon rod 800. The clamping jaw may be hydraulically or pneumatically controlled to automatically release or clamp the carbon rod 800, thereby eliminating a need of manually disassembling and assembling the carbon rod 800. When the carbon rod 800 is worn down, the clamping jaw may release the carbon rod 800 to allow the carbon rod 800 to fall into the metal liquid, without a need of collecting the worn-down carbon rods 800, which may eliminate provision of a device for automatically collecting the worn-down carbon rods 800.

Referring to FIGS. 7-10, based on the example embodiments described supra, in an implementation of the disclosure, the carbon rod 800 comprises a carbon rod body 810 and a large-diameter segment 820 at the upper end of the carbon rod body 810; the discharge port comprises a first discharge port 922 and a second discharge port 923, the size of the first discharge port 922 being smaller than that of the large-diameter segment 820, the size of the second discharge port 923 being greater than that of the large-diameter segment 820; when the carbon rod 800 falls off via the first discharge port 922, the large-diameter segment 820 abuts against the housing 920 around the first discharge port 922; a through groove 924 communicating mutually with the first discharge port 922 and the second discharge port 923 is disposed therebetween; after the carbon rod 800 is clamped, the clamping jaw, under the action of the translational mechanism 912, may bring the carbon rod 800 to move to the second discharge port 923 to thereby separate from the housing 920.

During the procedure of mounting the carbon rod 800, the carbon rod 800 first falls off via the first discharge port 922; after the carbon rod 800 falls a certain distance, the large-diameter segment 820 abuts against the housing 920 around the first discharge port 922 to be thereby kept at the first discharge port 922 (position a1 in FIG. 7), which prevents the carbon rod 800 from falling from the automatic carbon rod replacing mechanism. When the carbon rod 800 on the sealing assembly at the metal liquid control position is worn down, the other sealing assembly with the carbon rod 800 being completely mounted moves till the metal liquid control position; during this procedure, the clamping jaw brings the carbon rod 800 to move relative to the housing 920, causing the carbon rod 800 to move to the second discharge port 923 along the through groove 924 (in FIG. 7, the carbon rod moves from position a1 to position a3, where position a2 refers to a position traversed by the carbon rod during the movement process); since the size of the second discharge port 923 is larger than that of the large-diameter segment 820, descending of the clamping jaw brings the carbon rod 800 to descend along therewith, thereby blocking the metal liquid channel.

A cushioning pad 925 is disposed on the housing 920 around the first discharge port 922, the cushioning pad 925 being configured to buffer the carbon rod 800, preventing the carbon rod 800 from being ruptured due to the too large impact suffered during the falling. The cushioning pad 925 is a plastic piece or a silica gel piece, which protrudes upward from the housing around the first discharge port; when the clamping jaw brings the carbon rod to move, the bottom of the large-diameter segment can be detached from the cushioning pad while maintaining a gap with respect to the housing surrounding the through groove; in this way, no vibration-induced friction acting on the sealing assembly occurs between the carbon rod and the housing.

The carbon rod 800 further comprises a small-diameter segment 830 with a size greater than the carbon rod body 810, the small-diameter segment 830 being disposed below the large-diameter segment 820, a clamped segment 840 for the clamping jaw to clamp being formed between the large-diameter segment 820 and the small-diameter segment 830, the size of the small-diameter segment 830 being smaller than that of the first discharge port 922. The small-diameter segment 830 may pass through the first discharge port 922 smoothly without being blocked, such that the clamped segment 840 may project out of the housing 920 so as to be clamped by the clamping jaw; when the carbon rod 800 blocks the metal liquid channel, the carbon rod 800 is subjected to an upward counterforce, and via cooperation between the small-diameter segment 830 and the clamping jaw, relative displacement between the carbon rod 800 and the clamping jaw in the axial direction may be avoided, preventing leakage of the metal liquid channel.

Figure 7:
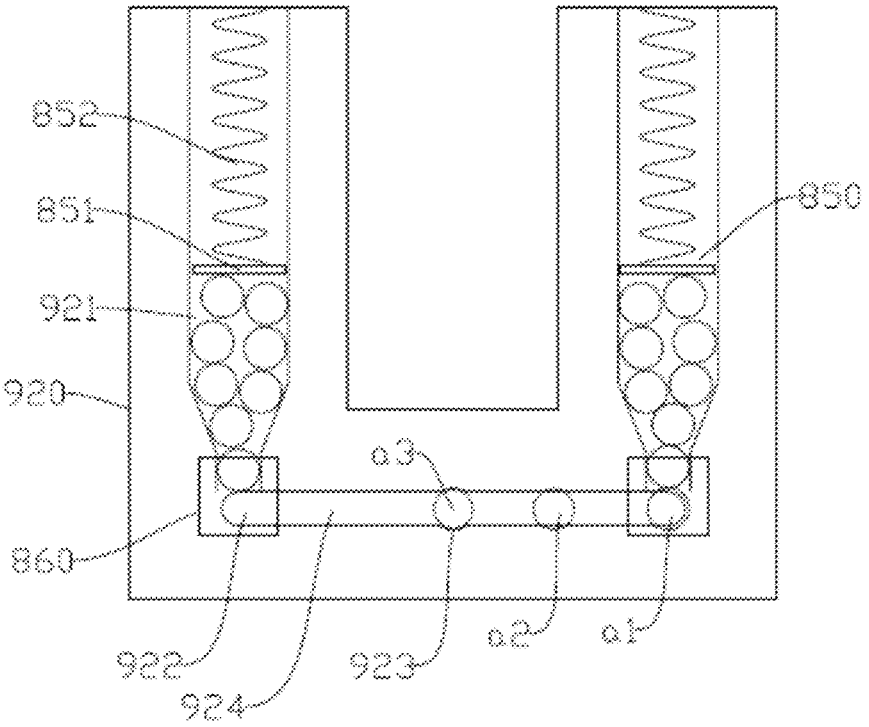
FIG. 7 is a cross-sectional diagram of an automatic carbon rod replacing mechanism in some embodiments of the disclosure.
Figure 8:
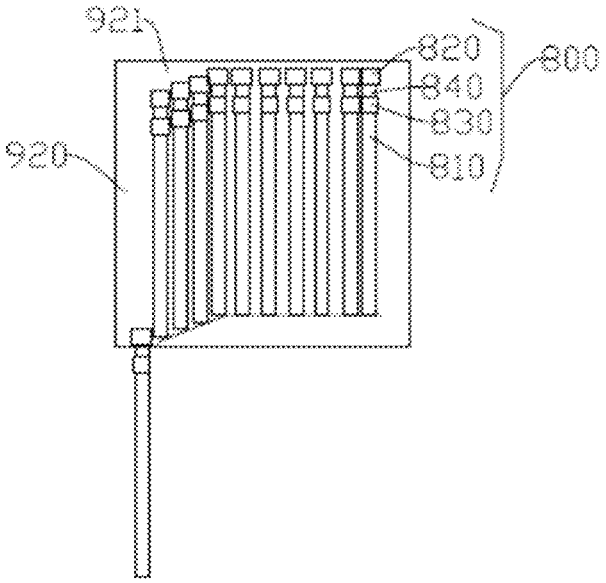
FIG. 8 is a side view of the automatic carbon rod replacing mechanism in some embodiments of the disclosure.
Figure 9:
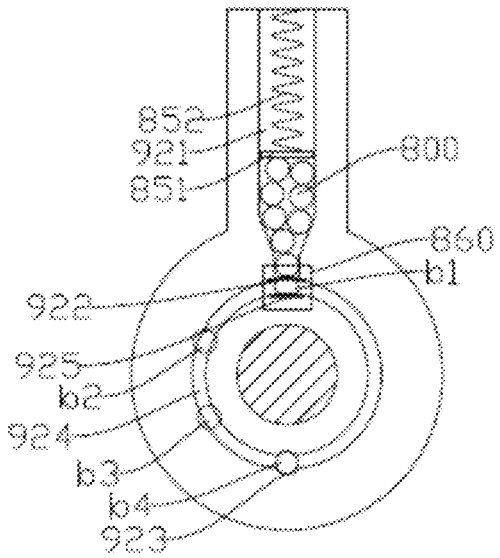
FIG. 9 is a cross-sectional view of an alternative automatic carbon rod replacing mechanism in some embodiments of the disclosure.

Referring to FIGS. 7 and 9, based on the example embodiments described supra, in an implementation of the disclosure, to enable the carbon rod 800 in the reservoir 921 to automatically move to the first discharge port 922 so as to fall therefrom, an elastic pressing plate 850 for pushing the carbon rod 800 to move towards the direction of the first discharge port 922 is provided in the reservoir 921, the end of the reservoir 921 proximal to the first discharge port 922 being gradually shrunk towards the direction of the first discharge port 922, and the bottom wall of the end of the reservoir 921 proximal to the first discharge port 922 being gradually inclined downwardly. The elastic pressing plate 850 may automatically push the carbon rod 800 to move towards the direction of the first discharge port 922 such that the carbon rod 800 may automatically fall off via the first discharge port 922 without interruption; by providing the end portion of the reservoir 921 to be gradually shrunk, the number of carbon rods 800 simultaneously passing therethrough may be limited, preventing two carbon rods 800 from simultaneously blocking the first discharge port 922; in addition, since the end portion of the reservoir 921 is shrunk, the elastic pressing plate 850 cannot project thereinto, and by providing the bottom wall of this portion to be inclined, the carbon rod 800 may automatically slide towards the direction of the first discharge port 922 without being pushed.

The elastic pressing plate 850 described supra comprises a pressing plate body 851 and a spring 852, the pressing plate body 851 being configured to push against the carbon rod 800, the spring 852 being connected to the pressing plate body 851 and providing an elastic force for pushing the pressing plate body 851 towards the direction of the first discharge port 922.

Figure 10:
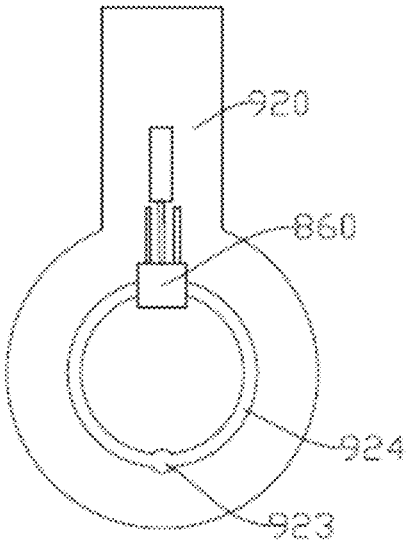
FIG. 10 is a bottom view of the automatic carbon rod replacing mechanism in some embodiments of the disclosure.

Referring to FIGS. 7, 9, and 10, based on the example embodiments described supra, in an implementation of the disclosure, a limit plate 860 and a drive mechanism for driving the limit plate 860 to slide are slidingly mounted below the first discharge port 922. The limit plate 860 may block the carbon rod 800 from falling off, avoiding a circumstance that the carbon rod 800 already projects out of the housing 920 and blocks movement of the clamping jaw before the clamping jaw moves below the first discharge port 922; the drive mechanism may control movement of the limit plate 860 so as to remove blockage to the carbon rod 800; the drive mechanism can also reset the limit plate 860 after the carbon rod 800 is moved by the clamping jaw, thereby resuming the blockage to the carbon rod 800 in the reservoir 921. The drive mechanism may be one of an air cylinder, an electric motor, an electric actuator, or a hydraulic cylinder.

Referring to FIGS. 9 to 11, different from the example embodiments described supra, in another implementation of the disclosure, the mounting bracket 900 comprises a fixed mounting bracket 903 and a rotary mounting bracket 904 rotatably mounted on the fixed mounting bracket 903, where two sealing assemblies are disposed at two sides of the rotary mounting bracket 904, respectively, the two sealing assemblies being symmetrical relative to the rotating axis center of the rotary mounting bracket 904; the housing 920 is fixedly connected to the fixed mounting bracket 903; a drive motor 905 for driving the rotary mounting bracket 904 to rotate is provided at the bottom of the housing 920; the rotary mounting bracket 904 brings the sealing assembly to rotate such that the carbon rod 800 moves from the first discharge port 922 to the second discharge port 923. The drive motor 905 may drive the rotary mounting bracket 904 to rotate relative to the fixed mounting bracket 903 so as to adjust the relative position between the two sealing assemblies, such that the two sealing assemblies may obtain a new carbon rod 800 from the same first discharge port 922; alternatively, only one reservoir 921 is provided in the housing 920. When the rotary mounting bracket 904 is rotating, the clamping jaw brings the carbon rod 800 to act synchronously, such that the carbon rod 800 may move from the first discharge port 922 to the second discharge port 923 (as illustrated in FIG. 9, the carbon rod falls till position b1, and with rotation of the rotary mounting bracket, the carbon rod moves from position b to position b4 along a circular path, where position b2 and position b3 refer to two positions traversed by the carbon rod during the moving process). After the carbon rod 800 is completely brought out of the housing 920 under the action of the lift mechanism 911, its position is further adjusted by the translational mechanism 912 so as to be aligned with the metal liquid channel.

The drive motor 905 may rotate the rotary mounting bracket 904 forwardly and reversely to switch the positions of the two sealing assemblies, and a through groove 924 thus formed is of a circular shape. A connecting column 870 is provided in the housing 920, the connecting column 870 being connected to the portion of the housing 920 surrounded by the through groove 924, thereby preventing this portion of structure from falling off due to lack of support; the drive motor 905 is mounted on the lower surface of this portion of structure, and a power supply circuit for powering the drive motor 905 may be arranged inside the connecting column 870.

What have been described supra are only specific implementations of the disclosure; however, the scope of protection of the disclosure is not limited thereto. Those skilled in the art shall appreciate that the disclosure includes, but is not limited to, the contents described in the drawings and the specific implementations. Any modification without departing from the functions and structural principles of the disclosure will be included in the scope of the appended claims.

We claim:

1. A casting furnace featuring submerged, mechanical control of liquid level, comprising:

a melting furnace, a holding furnace, and a crystallizer, the crystallizer comprising a chamber for accommodating metal liquid, the holding furnace communicating with the melting furnace and the chamber, respectively, a traction head being provided on the crystallizer, the chamber maintaining communication with the holding furnace, wherein the holding furnace comprises a liftable immersion device, the immersion device being submerged in the metal liquid to elevate liquid level height in the chamber; and the crystallizer has a liquid level detecting device, a lift height of the immersion device being adjusted based on a detection signal of the liquid level detecting device such that the liquid level in the chamber is maintained at a preset height, and wherein a lower end of the holding furnace is in communication with a lower end of the crystallizer, and a bottom wall of the holding furnace is lower than a bottom wall of the chamber.

2. The casting furnace featuring submerged, mechanical control of liquid level according to claim 1, wherein the immersion device comprises an immersion body and a lift rod connected to the immersion body, and a drive configured to drive the lift rod to perform an up-and-down movement relative to the holding furnace is provided on the holding furnace.

3. The casting furnace featuring submerged, mechanical control of liquid level according to claim 2, wherein the immersion body is hollow inside.

4. The casting furnace featuring submerged, mechanical control of liquid level according to claim 1, wherein the crystallizer further comprises a furnace body and a cooling jacket disposed on the furnace body, the chamber being defined by the furnace body, the traction head drawing the metal liquid from the cooling jacket such that the metal liquid is cooled into a metal billet in the cooling jacket.

5. The casting furnace featuring submerged, mechanical control of liquid level according to claim 1, wherein the bottom wall of the holding furnace is gradually elevated towards the direction of the crystallizer, the bottom wall of the chamber is gradually lowered towards the direction of the holding furnace, the holding furnace and the crystallizer communicate via a fluid channel, and one end of the fluid channel connected to the holding furnace is gradually elevated towards the other end thereof connected to the crystallizer.

6. The casting furnace featuring submerged, mechanical control of liquid level according to claim 1, wherein an upper end of the holding furnace is provided with a metal liquid inlet communicating with the melting furnace, a bottom wall of the melting furnace has a metal liquid outlet communicating with the metal liquid inlet, and the bottom wall of the melting furnace at a side of the metal liquid outlet is recessed downward to form an impurity deposition sector.

7. The casting furnace featuring submerged, mechanical control of liquid level according to claim 6, wherein a first baffle plate is provided at a side of the holding furnace proximal to the metal liquid inlet, a gap for the metal liquid to flow is formed between the first baffle plate and the bottom wall of the holding furnace, and an end of a bottom portion of the holding furnace distal from the gap communicates with the chamber.

8. The casting furnace featuring submerged, mechanical control of liquid level according to claim 6, wherein a second baffle plate is provided at a side of the melting furnace distal from the metal liquid outlet, a raw material inlet is enclosed between the second baffle plate and an end portion of the melting furnace, and the impurity deposition sector is located outside a projection range of the raw material inlet in a vertical direction.

9. The casting furnace featuring submerged, mechanical control of liquid level according to claim 8, wherein a third baffle plate is provided at the bottom wall of the holding furnace proximal to the crystallizer, one side of the third baffle plate facing the crystallizer is a flow guide surface skewing towards the crystallizer from top to bottom.

10. The casting furnace featuring submerged, mechanical control of liquid level according to claim 9, wherein the third baffle plate is disposed lower than a cast center of the traction head, a plurality of through-holes spaced along a height direction being provided on the third baffle plate.

11. The casting furnace featuring submerged, mechanical control of liquid level according to claim 6, further comprising a double-acting switch valve, the double-acting switch valve comprising a mounting bracket and two mutually backup sealing assemblies disposed on the mounting bracket, each sealing assembly comprising a carbon rod and a carbon rod moving assembly, the carbon rod moving assembly being configured to translate, and elevate or lower the carbon rod so as to block or open the metal liquid outlet via the carbon rod.

12. The casting furnace featuring submerged, mechanical control of liquid level according to claim 1, wherein a plurality of immersion devices are provided, the plurality of immersion devices sequentially descending into the metal liquid during continuous casting.

13. The casting furnace featuring submerged, mechanical control of liquid level according to claim 1, wherein the liquid level detecting device comprises a float ball, a floating rod connected to the float ball, and a sensor configured to detect displacement of the floating rod to determine a liquid level height, a positioning mechanism being provided on the crystallizer, the positioning mechanism comprising at least two roller sets spaced along a vertical direction, each of the two roller sets comprising rollers pairwise disposed at two sides of the floating rod and rolling with floating of the floating rod.

* * * * *